US005214865A

United States Patent [19]

Sartor

[11] Patent Number: 5,214,865

[45] Date of Patent: Jun. 1, 1993

[54] SHOCK ABSORBING HEEL ATTACHMENT FOR A SKI SHOE

[75] Inventor: Mario Sartor, Treviso, Italy

[73] Assignee: Calzaturificio Brixia S.p.A., Treviso, Italy

[21] Appl. No.: 842,335

[22] PCT Filed: Jul. 23, 1990

[86] PCT No.: PCT/EP90/01209

§ 371 Date: Mar. 20, 1992

§ 102(e) Date: Mar. 20, 1992

[87] PCT Pub. No.: WO92/01397

PCT Pub. Date: Feb. 6, 1992

[51] Int. Cl.[5] ..... A43B 5/04

[52] U.S. Cl. ..... 36/117; 36/132; 280/613

[58] Field of Search ..... 36/117, 118, 119, 120, 36/121, 132, 36 R; 280/611, 613, 614, 615, 623

[56] References Cited

U.S. PATENT DOCUMENTS

| | | | |
|---|---|---|---|
| 3,594,929 | 7/1971 | Stoehr | 36/44 |
| 4,542,599 | 9/1985 | Annori | 36/117 |
| 4,901,454 | 2/1990 | Walkhoff | 36/117 |
| 4,937,955 | 7/1990 | Bonaventure | 36/132 |
| 4,945,659 | 8/1990 | DeMarchi et al. | 36/117 |
| 5,054,213 | 10/1991 | Bonaventure | 36/117 |
| 5,086,575 | 2/1992 | Bonaventure | 36/117 |

FOREIGN PATENT DOCUMENTS

| | | |
|---|---|---|
| 0152017 | 8/1985 | European Pat. Off. . |
| 0587032 | 3/1977 | Switzerland . |

*Primary Examiner*—David T. Fidei
*Assistant Examiner*—M. D. Patterson
*Attorney, Agent, or Firm*—Flynn, Thiel, Boutell & Tanis

[57] ABSTRACT

A ski shoe having a stiff shell and a shock-absorbing device which includes an elastic element and a heel member, the elastic element being provided between an underside of the stiff ski shoe shell and the heel member. The elastic element being adapted to absorb vertical shock forces. The elastic element has a profile projecting upwardly from a plate-like section, which profile fits into a recess in an underside of the shell. An upwardly projecting support part on the heel member is received into a recess provided in the profile, the upper edge of the support part projecting higher than a plane containing the plate-like section of the elastic element.

8 Claims, 3 Drawing Sheets

SHOCK ABSORBING HEEL ATTACHMENT FOR A SKI SHOE

FIELD OF THE INVENTION

The invention relates to a stiff shell ski shoe comprising a heel located shock-absorbing device.

BACKGROUND OF THE INVENTION

Such a ski shoe has become accessible to the general public through products and catalogues since the ISPO '90 (San Marco 1991/Space 2001). This known design has an elastic element between the underside of a stiff shell and a sole made of an essentially strong or stiff material, which element absorbs shock forces and impacts which act onto the leg of the skier, mainly in the heel area. However, in the case of impacts from a horizontal direction unfavorable shearing strains can occur between the elastic element and the ski shoe parts made of stiff or hard material, which ski shoe parts rest on the element. This strain can result in undesired wear, which does not optimally guarantee the strength of the ski shoe needed for the release of a safety ski binding.

Further known designs are illustrated in CH-PS 587 032; the elastic devices or inserts in this patent have, however, the purpose of making the rolling movement during walking easier.

DE-OS 37 42 918 also illustrates elastic elements in the heel area in some of their embodiments, with the elastic elements being directly in or on the heel. The heel is thereby constructed in one piece with the sole or is fastened to the underside of the shell through a releasable connection. Since a stiff rib exists between the elastic elements, which rib transfers the forces directly from the heel onto the shell and thus onto the foot of the skier, the shock-absorbing effect acting in the vertical plane is here also lost. Only the forces occurring during a specific position of the ski shoe, for example during edging, can therefore be absorbed.

The purpose of the present invention is to bring help here and to assure, while maintaining the necessary strength characteristic, an effective shock absorption without limiting the active direction of force.

SUMMARY OF THE INVENTION

The objects and purposes of the invention have been met by providing a ski shoe having a stiff shell and a shock-absorbing device which includes an elastic element and a heel member, the elastic element being provided between an underside of the stiff ski shoe shell and the heel member. The elastic element is adapted to absorb vertical shock forces. The elastic element has a profile projecting upwardly from a plate-like section, which profile fits into a recess in an underside of the shell. An upwardly projecting support part on the heel member is received into a recess provided in the profile, the upper edge of the support part projecting higher than a plane containing the plate-like section of the elastic element.

BRIEF DESCRIPTION OF THE DRAWINGS

The invention will now be described in greater detail in connection with the drawings illustrating three exemplary embodiments. In the drawings.

DETAILED DESCRIPTION

Figure 1:
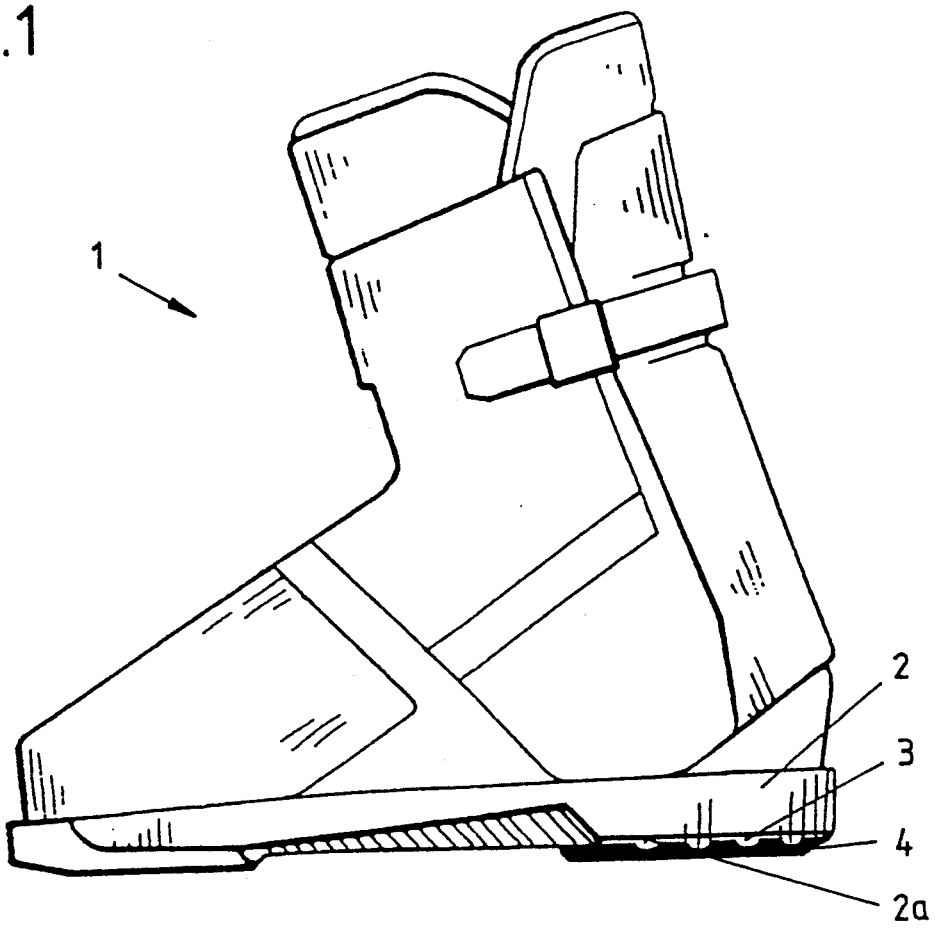
FIG. 1 is a side view of a ski shoe embodying the invention.

FIG. 1 shows a ski shoe 1 in its entirety with an elastic element 3 and a releasable heel 4 on a stiff shell portion 2.

Figure 2:
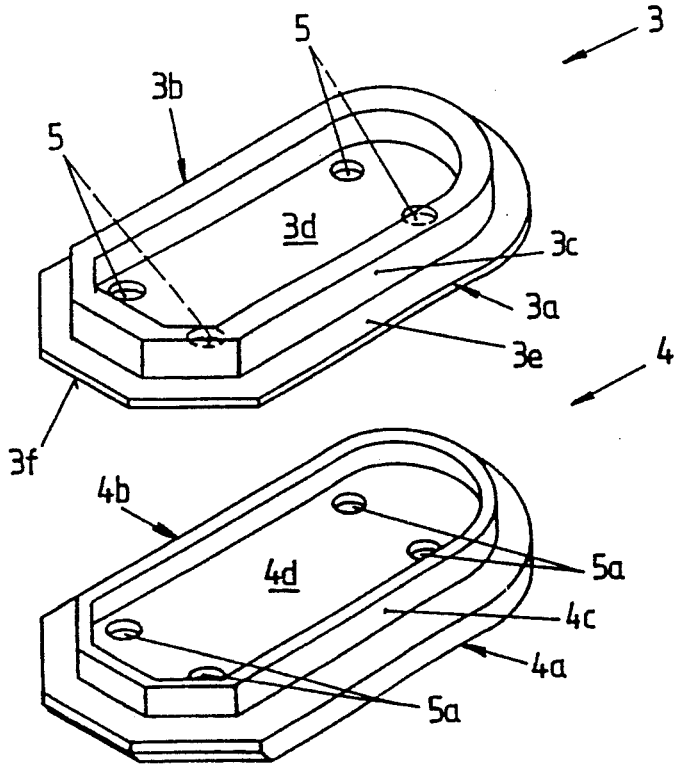
FIG. 2 is a perspective view of the elastic element and the heel according to a first exemplary embodiment, FIG. 2*a* according to the second exemplary embodiment, and FIG. 2*b* according to the third exemplary embodiment.

FIG. 2 shows an isometric view of the elastic element 3 and the heel 4 together in an exploded illustration. The elastic element 3 includes a plate 3*a* and an upwardly directed and self-contained profile 3*b*. In the top view, the plate 3*a* has a trapezoidal shape on its side facing the tip of the ski shoe, the region of the plate 3*a* remote from the tip of the ski shoe is designed as an arc.

The upwardly directed profile 3*b* has outwardly facing surfaces 3*c*, which extend within and essentially parallel to the outer contour of the plate 3*a*. The profile 3*b* confines a surface 3*d* having four through openings 5 through which fastening screws (not illustrated) extend.

The surface 3*d* and an upwardly facing side section the plate 3*a*, which section is oriented outside of the profile 3*b*, form a horizontal plane on which the elastic element 3 is supported on an underside 2*a* of the shell 2 of the ski shoe 1, which underside is not illustrated in this figure (compare FIG. 1).

Figure 4:
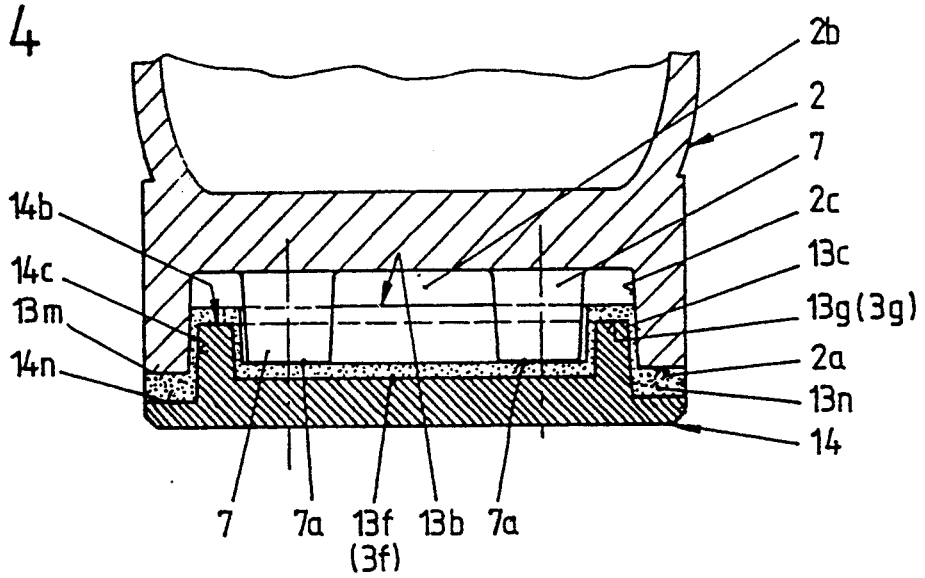
FIGS. 4 and 5 are cross sections taken along the line IV—IV or V—V of FIG. 3.
Figure 5:
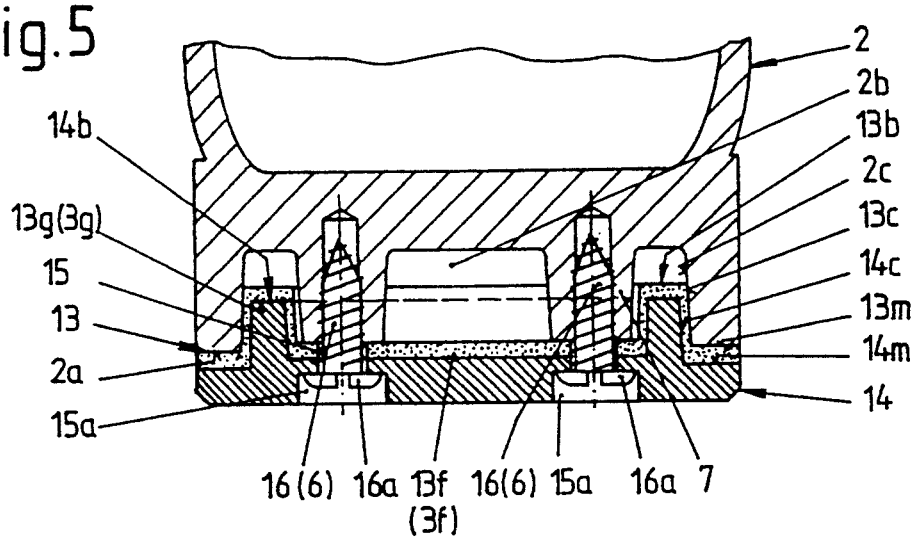
Figure 3:
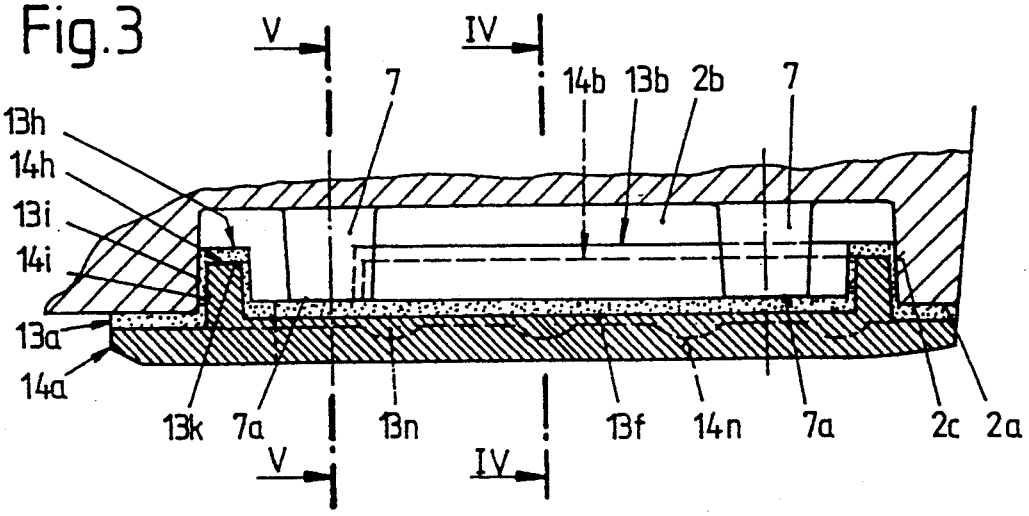
FIG. 3 is a longitudinal cross-sectional view of a detail of FIG. 1 according to the second exemplary embodiment.

The elastic element 3 has a recess 3*g* on its underside 3*f*, with this recess being constructed as a groove and extending beneath and into the profile 3*b* (compare FIGS. 3–5).

FIG. 2 also illustrates, as already mentioned, the releasable heel 4 manufactured of a strong or stiff material, with the heel having a plate 4*a*, the outer contour of which corresponds with the outer contour of the plate 3*a* of the elastic element.

The plate 4*a* has an upwardly projecting support part 4*b*, the side surfaces 4*c* of which extend essentially also within and parallel to the outer contour of the plate 4*a* like the profile 3*b* on the elastic element 3. A surface 4*d* defined by the support part 4*b* has four stepped bores 5*a* which receive fastening screws not illustrated in this figure (compare reference numeral 6 in FIG. 5).

FIG. 2 shows mainly a principal design of the invention. The cooperation of the individual parts will now be explained using a second embodiment according to FIGS. 2*a* to 5, which second embodiment is preferred in practice. These figures show also the design of the shell 2 of the ski shoe 1.

Figure 2A:
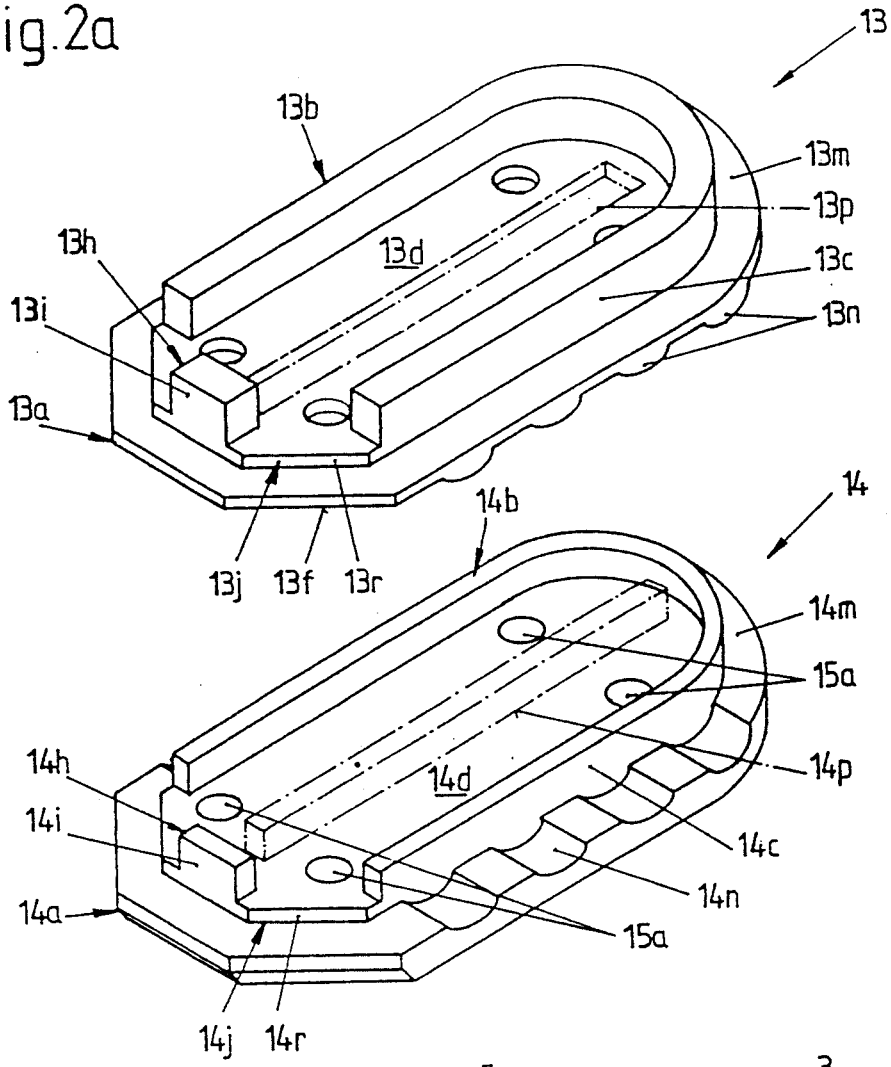

FIG. 2*a* shows an elastic element 13 and a heel 14. The design and structure of the two parts correspond essentially with the first embodiment according to FIG. 2, the difference being that the plate 13*a* of the elastic element 13 has two upwardly projecting profiles 13*b*, 13*h* each with outwardly facing surfaces 13*c*, 13*i* and the plate 14*a* of the heel 14 has two upwardly projecting support parts 14*b*, 14*h* each with outwardly facing surfaces 14*c*, 14*i*. The profiles 13*b*, 13*h* and the support parts 14*b*, 14*h* each confine here a respective surface 13*d* and 14*d* having through openings 15 or stepped bores 15*a*.

An intermediate plate section 13*j* forming a recess exists between the profiles 13*b*, 13*h* and the plate 13*a*.

An intermediate plate section 14*j* extending between the support parts 14*b*, 14*h* and the plate 14*a* snugly extends into the recess. Each of the intermediate plate sections 13*j*, 14*j* has an outwardly facing surface 13*r*, 14*r*, the outer contour of which extends within and is essentially parallel to the outer contour of the respective plate 13*a* or 14*a*.

The profile 13*b* and the support part 14*b* have an essentially U-shaped design as viewed from the top, with the open side of the profile 13*b* and of the support part 14*b* facing in direction of the tip of the ski. The plate 13*a* of the elastic element 13 has at and in the space of the open side a second profile 13*h* constructed as a horizontally oriented prism. The plate 14*a* of the heel 14 has a similarly designed and arranged support part 14*h*. The longitudinal axis of the second profile 13*h* and of the support part 14*h* extends perpendicularly with respect to the longitudinal axis of the ski shoe.

The elastic element 13 has two recesses 13*g*, 13*k* on its underside. These recesses are constructed as grooves and extend beneath and into the profiles 13*b* or 13*h* (compare FIGS. 3–5). An underside of the section 13*m* of the plate 13*a*, which section extends outside of the recess 13*g*, has downwardly projecting projections 13*n* constructed as horizontally oriented segments of circular cylinders.

An upper side of the section 14*m* of the plate 14*a*, which section extends outside of the support part 14*b*, has recesses 14*n* also constructed as horizontally oriented segments of circular cylinders.

FIGS. 3 to 5 show the heel 14 and the elastic element 13 form-lockingly connected with one another and mounted on the underside 2*a* of the shell 2. A positive lock is created by the downwardly projecting projections 13*n* on the elastic element 13 extending into the recesses 14*n* on the heel 14, and by the receipt of the support parts 14*b*, 14*h* on the heel 14 into the recesses 13*g*, 13*k* on the underside 13*f* of the elastic element 13.

The underside 2*a* of the shell 2 has a recess 2*b* with four downwardly projecting pegs 7, each of which is formed to receive a fastening screw 16 therein. The profiles 13*b*, 13*h* of the elastic element 13 and the support parts 14*b*, 14*h* of the heel 14 project furthermore into the recess 2*b* of the shell 2 in the mounted state of the shock-absorbing device. The elastic element 13 is thereby supported, viewed in the horizontal plane, on the underside 2*a* of the shell 2 and on faces 7*a* on the pegs 7. The outwardly facing surfaces 13*c*, 13*i* of the profiles 13*b*, 13*h* rest on sidewalls 2*c* of the recess 2*b*. The recess 2*b* conforms in its front region with the contour of the side facing surfaces 13*r* of the intermediate plate 13*j* (not illustrated).

FIG. 5 shows that the stepped bores 15*a* on the underside of the heel 14 are constructed such that the heads 16*a* of the fastening screws 16 are countersunk in a manner which with certainty avoids, with any compression of the elastic element 13, a projecting of the heads 16*a* from the underside of the heel 14.

The ski shoe 1 is according to FIGS. 1 and 3 to 5 in the rest position. If, however, an impact or hit occurs from below onto the ski shoe 1, then the elastic element 3, 13 is compressed between the underside 2*a* of the shell 2 or the faces 7*a* of the pegs 7 and the heel 4, 14 to facilitate a shock absorption.

The elastic element 3, 13 is during impacts from a lateral direction compressed between the sidewalls 2*c* of the recess 2*b* and the outwardly facing surfaces 14*c*, 14*i* of the support parts 14*b*, 14*h* of the heel 14.

Since a combination of horizontal and vertical stresses occurs in most cases, a corresponding deformation and, therefore, also shock absorption is thus assured in all directions.

The invention is not to be limited to the illustrated and described embodiments. Further modifications are conceivable without departing from the scope of protection. For example, it is possible to provide the heel plate according to the invention with a longitudinal rib (see reference numeral 14*p* illustrated in dash-dotted lines in FIG. 2*a*) in order to increase the resistance to bending of the heel. In order to not influence the action of the shock-absorbing device, the height distance between the top of the longitudinal rib and the underside of the shell is greater than the extent of the intended compression.

The plate of the elastic element has furthermore a corresponding through opening for receiving the longitudinal rib therein (see reference numeral 13*p* illustrated in dash-dotted lines in FIG. 2*a*), which through opening does not influence the shock absorption characteristic. To increase the resistance to bending of the heel, other rib constructions with corresponding through openings in the plate of the elastic element are also important in the invention, for example, in the form of a cross or a double cross, a horizontally oriented X and the like.

Figure 2B:
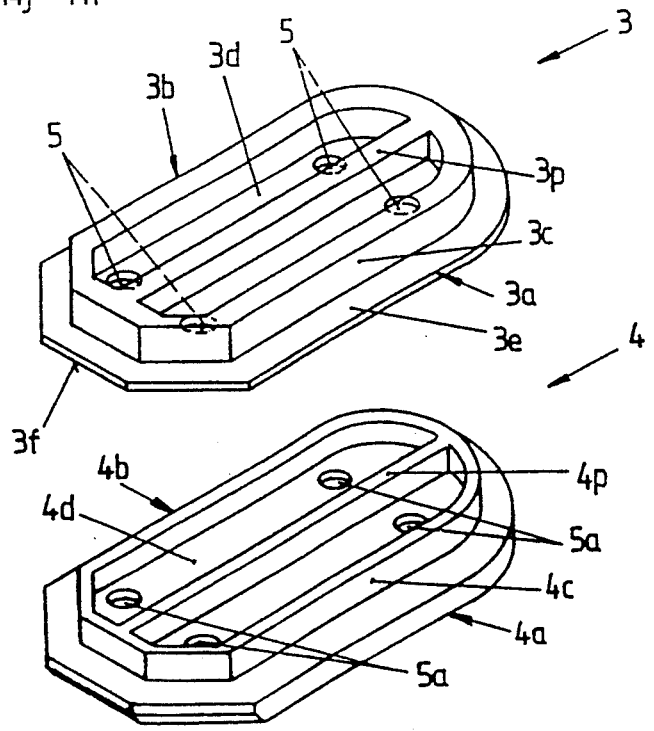

FIG. 2*b* shows a modification in which a rib 3*p* on the surface 3*d* of the elastic element 3 is also associated with a rib 4*p* on the surface 4*d* of the heel 4. Design and operation of this modification correspond with what has already been described.

Also the type of fastening of the heel to the underside of the ski shoe is not to be limited to the use of fastening screws, since a riveting, gluing or welding is also conceivable.

The embodiments of the invention in which an exclusive property or privilege is claimed are defined as follows:

1. In a ski shoe comprising a rigid shell and a shock-absorbing device which are designated to cooperate with binding devices on a ski, said shock absorbing device including a heel member made of a stiff material and a compressible elastic element located in a heel area of said ski shoe, said elastic member being located between an underside of said shell and said heel member, the improvement wherein said underside of said shell has a recess, wherein said heel member has a plate-like section, wherein said elastic element also has a plate-like section and at least one profile projecting upwardly from said plate-like section thereof, said profile having an outwardly facing surface resting against sidewalls of said recess, wherein said profile has at least one recess on an underside thereof into which is received at least one upwardly projecting support part on said plate-like section of said heel member, and wherein an upper edge of said projecting support part extends to a position located above a plane containing said plate-like section of said elastic element.

2. The ski shoe according to claim 1, wherein said elastic element has two upwardly projecting profiles, a first of said profiles having an essentially U-shape in a top view thereof and a second of said profiles having a horizontally extending prism shape, a longitudinal axis of said prism being positioned perpendicularly with respect to a longitudinal axis of said ski shoe, and wherein said second profile is arranged on said elastic element spaced from said first profile, and wherein said heel member also has two upwardly projecting support parts each of which extends into a respective recess provided in said first and second profiles of said elastic element.

3. The ski shoe according to claim 2, wherein said elastic element has an intermediate plate-like section oriented above said plate-like section thereon, said first and second profiles being provided on an upwardly facing surface of said intermediate plate-like section, said intermediate plate-like section having an outwardly facing contour extending within and generally parallel with respect to said outer contour of said plate-like section.

4. The ski shoe according to claim 2, wherein said plate-like section of said elastic member has a further recess in an underside thereof in the region of said intermediate plate-like section, and wherein said heel member also has an intermediate plate-like section conforming in size and shape to and is received in said further recess.

5. The ski shoe according to claim 1, wherein said elastic element has downwardly projecting projections on an underside of said plate-like section, and wherein said plate-like section of said heel member has further upwardly opening recesses conforming in size and shape to and receives therein said downwardly projecting projections.

6. The ski shoe according to claim 5, wherein said downwardly projecting projections on said elastic element and said upwardly opening recesses on said heel member each have a shape corresponding to horizontally extending segments of circular cylinders.

7. The ski boot according to claim 1, wherein said heel member is releasably fastened to said underside of said shell by means of fastening screws, and wherein said fastening screws each have enlarged heads thereon which are received in countersunk stepped bores in said heel member, said heads remaining, during any compression of said elastic element, within the thickness of said heel member.

8. The ski shoe according to claim 1, wherein said compressible elastic member is made of rubber.

* * * * *